United States Patent [19]

Sproul, Sr.

[11] Patent Number: 4,837,569

[45] Date of Patent: Jun. 6, 1989

[54] TRAFFIC SIGNAL DIRECTIONAL INDICATOR DEVICE

[75] Inventor: Fred C. Sproul, Sr., San Marcos, Calif.

[73] Assignee: Fred C. Sproul, Sr., Patents, Inc., Irvine, Calif.

[21] Appl. No.: 64,386

[22] Filed: Jun. 22, 1987

[51] Int. Cl.[4] ..... G08G 1/095; E01F 9/00

[52] U.S. Cl. ..... 340/907; 40/553

[58] Field of Search ..... 340/907, 908, 84, 89, 340/107, 119, 108, 110; 40/575, 576; 116/63 R

[56] References Cited

U.S. PATENT DOCUMENTS

| | | | |
|---|---|---|---|
| Re. 28,852 | 6/1976 | Sproul, Sr. | 340/107 |
| 1,530,210 | 3/1925 | Seitz | 40/576 |
| 1,567,871 | 1/1923 | Sitz . | |
| 1,577,125 | 3/1926 | Jackson | 340/907 |
| 1,616,604 | 2/1927 | Brophy . | |
| 1,805,406 | 5/1931 | Lackner . | |
| 1,917,165 | 7/1933 | Thompson . | |
| 2,001,440 | 5/1935 | West . | |
| 2,006,675 | 7/1935 | Ferguson . | |
| 2,191,353 | 2/1940 | Poblocki | 40/576 |
| 2,205,169 | 5/1937 | Hallman . | |
| 2,850,717 | 9/1958 | Wiswell | 340/84 |
| 3,200,218 | 8/1965 | Wagner . | |
| 3,210,728 | 10/1965 | Davis | 340/107 |
| 3,400,366 | 9/1968 | Downing | 340/124 |
| 3,436,729 | 4/1969 | Zurcher . | |

*Primary Examiner*—Joseph A. Orsino
*Assistant Examiner*—Brian R. Tumm
*Attorney, Agent, or Firm*—Stetina and Brunda

[57] ABSTRACT

An improved traffic signal directional indicator device comprises a housing which may be mounted onto a conventional traffic signal and be illuminated to provide indicia pertaining to a motorist's particular direction of travel, i.e. North, Northeast, South, etc. The improved traffic signal directional indicator device may be rapidly retrofitted onto existing traffic signals and function without adversely affecting the normal operation of the traffic signal.

4 Claims, 1 Drawing Sheet

TRAFFIC SIGNAL DIRECTIONAL INDICATOR DEVICE

BACKGROUND OF THE INVENTION

The present invention relates generally to devices for use on traffic signals and more particularly to an improved traffic signal directional indicator device wherein a light housing may be mounted onto a conventional traffic signal and be illuminated to include indicia pertaining to the particular direction of travel of a motorist.

As is well known, directional information is normally not provided to motorists in the United States, and if provided, is typically provided solely by way of lettered road signs located along the sides of roadways. With particular reference to motorist information pertaining to compass bearings of the street along which the motorist is traveling, such information usually is only provided on the street sign in reference to street number addresses, for example, North or South. As such, motorists must continually glance away from the roadway and traffic signal devices located on the roadway to search out such signs in an attempt to determine the particular direction in which they are traveling. As will be recognized, the continuous glancing to the side of the roadway constantly poses a safety hazard to the motorist. Further, due to the relatively minimal amount of directional information given on such street signs, motorists are not fully informed of the precise compass bearing while traveling on the roadway.

In addition, due to such directional information being provided on road signs which are relatively small in size and typically not illuminated during evening hours, it is oftentimes difficult, if not impossible, to observe and understand such street signs while traveling on the roadway. As such, there exists a substantial need in the art for an improved traffic signal directional indicator device which may be utilized in conjunction with conventional traffic signals to provide a convenient and readily observable means for a motorist to determine his compass bearing during travel on a roadway.

In recognizing this substantial need, the subject applicant previously developed a traffic signal with directional indicator as disclosed in U.S. Pat. No. Re. 28,852, which reissued on June 8, 1976. The invention disclosed therein comprises the use of substantially translucent lenses to be used in combination with standard traffic control signals wherein information relating to the direction of vehicles is provided in such a manner on the lenses that motorists are constrained to view the information while observing the traffic signal. Although the traffic signal and directional indicator device disclosed in U.S. Pat. No. Re. 28,852 has proven to be effective, the directional information superimposed directly upon the traffic signal lens has caused some concern by governmental agencies and in particular the Federal Highway Commission that the directional information will mask off a significant portion of the traffic signal indicator and thereby deter the complete recognition of the traffic signal indicator by motorists and possibly confusing the motorist. Further, some concern pertaining to the inventory and retrofitting requirements of the translucent lenses of U.S. Pat. No. Re. 28,852 have deterred from the overall acceptance of the technology by governmental agencies. Thus, there still exists a need in the art for a traffic signal directional indicator device which can be effectively utilized to inform motorists of compass bearing directions in a convenient and safe manner while driving upon a roadway.

The present invention specifically addresses and alleviates the above-reference deficiencies associated in the prior art by providing an improved traffic signal directional indicator device wherein a separate light housing may be mounted onto a conventional traffic signal housing. The light housing is preferably continuously illuminated and includes a front panel having indicia formed thereon representing the particular direction of travel upon a roadway, i.e. North, Northeast, South, Southwest, etc. The housing of the improved traffic signal directional indicator device includes a mounting plate portion formed in a complementary configuration to the top portion of conventional traffic signals so as to register or align the housing upon the traffic signal in a rapid manner. Further, the indicia pertaining to the particular direction of travel is provided on a planar element which may be easily inserted and removed from the housing to provide ease in installation as well as permit rapid replacement of the light source within the device.

The unique improved traffic signal directional indicator device of the present invention exhibits a number of significant advantages over the traditional roadside sign devices utilized to provide minimal directional information to motorists. Foremost of these advantages is the fact that since every motorist must observe traffic signals upon the roadway while traveling, the motorist will necessarily observe the directional compass bearing information simultaneously with viewing of the traffic signal and thus, need not glance about to the sides of the roadway during travel. Further, due to the directional information being continuously illuminated in the improved traffic signal directional indicator device of the present invention, the observation of such directional information may be readily observed during both daylight and evening hours and is not dependent upon illumination of the signal lens of the traffic signal. Further, the use of the improved traffic signal directional indicator device does not mask or detract from the observation of the conventional lenses upon the traffic signals so as to pose any possibility of a detraction from the normal operation of the traffic signal. In addition, the traffic signal directional indicator can be an optional installation in any city or state municipality which desires its use.

DESCRIPTION OF THE DRAWINGS

These as well as other features of the present invention will become more apparent upon reference to the drawings wherein.

DETAILED DESCRIPTION OF THE PREFERRED EMBODIMENT

Figure 1:
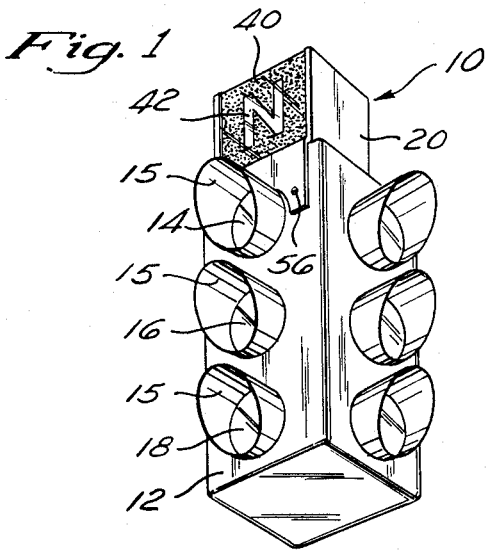
FIG. 1 is a perspective view of a conventional traffic signal illustrating the preferred location and method of mounting the improved traffic signal directional indicator device of the present invention thereon.

Referring to FIG. 1, there is shown the improved traffic signal directional indicator device of the present invention designated generally by the numeral 10 which is mounted upon the upper portion of a conventional traffic signal device 12. As is well known, such traffic signal devices 12 include one or more differing colored lenses 14, 16, and 18 which typically comprise the colors red, amber and green, respectively, which are selectively illuminated by conventional switch circuitry (not shown) to alert an approaching motorist to traffic conditions at the traffic intersection where the traffic signal 12 is positioned.

Figure 2:
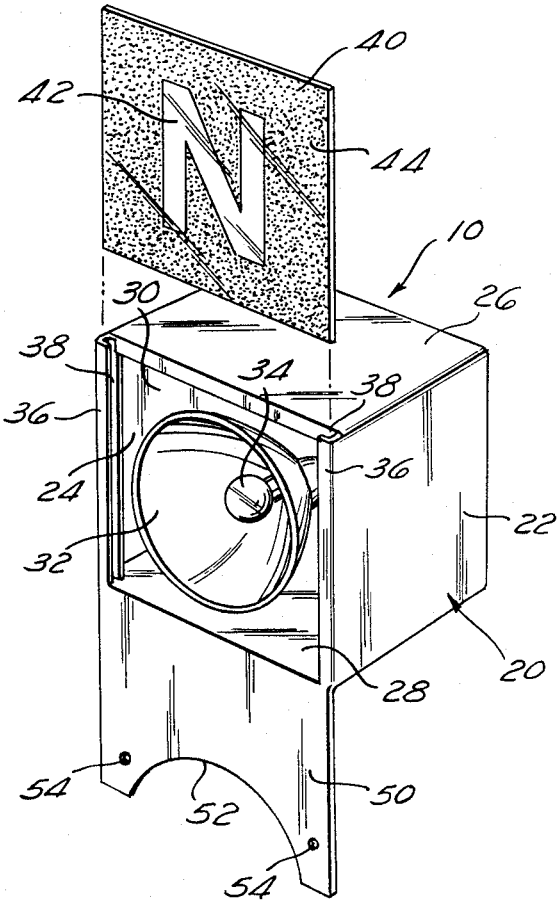
FIG. 2 is a perspective view of the improved traffic signal directional indicator device of the present invention depicting its construction.

As best shown in FIG. 2, the improved traffic signal directional indicator device 10 is composed of a generally rectangular housing 20 preferrably formed of sheet metal defining a pair of side walls 22 and 24, top wall 26, bottom wall 28 and rear wall (not shown) to define an interior enclosure 30. A parabolic reflector 32 is disposed within the interior enclosure 30 of the housing 20 and mounts a conventional light source 34 coaxially therein which light source 34 preferably comprises an incandescent light bulb. As will be recognized, the light source 34 is electrically connected to a conventional base (not shown) for instance, an Edison base which may receive electrical power from an electrical source typically such as that electrical source provided to the traffic signal 12.

As best shown in FIG. 2, the side walls 22 and 24 of the housing 20 typically include an L shaped extension 36 at their frontal edge which define a pair of vertically extending slots or channels 38. The slots 38 are sized to receive therein a planar element 40 typically formed of a substantially translucent material such as glass or plastic. The planar element 40 includes indicia thereon 42 indicative of a particular compass bearing direction which for example, as shown in FIG. 2 comprises the letter "N", indicative of the compass bearing direction North, but those skilled in the art will recognize that other compass directions are contemplated herein, such as South, East, West as well as combinations of the same, i.e. Northeast, Southwest, North Northwest, etc when more definite compass directions are desired. In the preferred embodiment, the indicia 42 is formed by providing an opaque mask or covering 44 on one side of the planar element 40, which mask 44 is removed from a portion of the planar element 40 defining the indicia 42. As such, the indicia 42 is the only portion of the planar element 40 which permits the passage of light therethrough such that the same is illuminated by the light source 34 and readily observable by a motorist. In the preferred embodiment, the mask 44 may comprise a variety of materials such as paint or other surface covering which adheres to the planar element 40.

The planar element 40 is installed upon the housing 20 by insertion of its side edges into the vertical slots or channels 38 formed on the housing 20 and when installed thereon completely covers the parabolic reflector 32 and light source 34 to form the front surface of the housing 20. As will be recognized, when necessary, for instance to permit replacement of the light source 34 therein, the planar element 40 may be manually lifted upwardly from the channels 38 and subsequently return to its normal position. The front portion of the housing 20 additionally includes a downwardly extending planar mounting flange or portion 50, the lower edge of which includes a semi-circular recess 52 formed in a complementary configuration to the curvature of the lens 14 and/or the lens shroud 15 of the traffic signal 12. A pair of apertures 54 are additionally provided adjacent the recess 52.

With the structure defined, the installation of the improved traffic signal directional indicator device 20 of the present invention upon a conventional traffic signal 12 may be described. Initially, the housing 20 must be positioned upon the top surface of the traffic signal 12 and conventional electrical connections must be facilitated from the electrical power source or circuitry (not shown) of the traffic signal 12 to the light source 34. Subsequently, the housing 20 may be lowered upon the traffic signal 12 such that the semi-circular recess 52 partially encircles the lens shroud 15 of the traffic light 12. As will be recognized, due to the semi-circular recess 52 being formed in a complementary configuration to the lens shroud 15, the housing 20 is self-registered or coaxially aligned with the lenses 14, 16 and 18 of the traffic signal 12. Subsequently, suitable fasteners such as sheet metal screws 56 (shown in FIG. 1) may be inserted through the apertures 54 formed in the flange portion 50 of the housing 20 and be threadingly inserted into the traffic signal 12 thus securing the device 10 to the upper surface of the traffic signal. The planar element 40 having appropriate directional indicia 42 formed thereon may then be inserted into the vertically extending slots 38 formed in the housing 20 wherein the immproved traffic signal directional indicator device 10 of the present invention is fully operational.

In operation a motorist traveling toward the traffic light 12 would immediately observe the letter "N", indicia 42, formed on the planar element 40, thereby immediately indicating the compass bearing direction of travel of the motorist upon the road. Further, since the letter "N" indicia is continuously illuminated and not incorporated directly upon the traffic light lens 14, 16 and 18, the motorist is not confused or distracted by the operation of the same.

Figure 3:
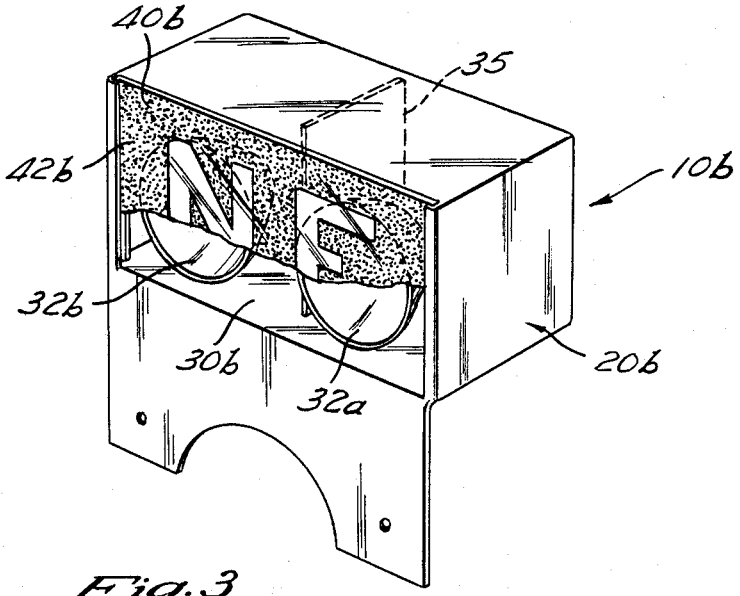
FIG. 3 is a perspective view of an additional embodiment of the improved traffic signal directional indicator device of the present invention.

In FIG. 3 an additional embodiment of the improved traffic signal directional indicator device **10*b* of the present invention which is analogous to the embodiment 10 shown in FIGS. 1 and 2, except that a pair of parabolic reflectors 32*a* and 32*b* are mounted within the interior enclosure 30*b* of the housing 20*b*. In addition, the housing 20*b* includes a central support member 34 which terminates short of the planar element 40*b*. In this additional embodiment it will be recognized that due to the use of a pair of parabolic reflectors 32*a* and 32*b* as well as their corresponding light sources, redundancy of the light source is provided such that upon intermittent failure of one of the light sources, the directional indicator device 10*b*** will remain operational by way of the additional light source until such time a suitable replacement of the light source can be effectuated.

Although certain material compositions and configurations have been defined herein, those skilled in the art will recognize that various modifications of the same are contemplated and such modifications are encompassed within the spirit of the present invention.

What is claimed is:

1. A traffic signal directional indicator device comprising:

a housing sized to be supported upon a traffic signal defining an enclosure;

a light source positioned within said enclosure;

a reflector positioned within said enclosure to direct said light source outwardly therefrom;

a planar element removably mounted to said housing and positioned outwardly from said light source;

indicia formed on said planar element representing a compass bearing direction; and means formed on said housing for registering and mounting said housing to the traffic signal, said registering and mounting means comprising a planar extension from said housing sized to extend over a portion of the traffic signal; and a recess on said planar extension formed in a complementary configuration to a lens shroud of the traffic signal.

2. The device of claim 1 wherein said recess comprises a semi-circular shaped recess.

3. The device of claim 2 wherein said indicia is formed on said planar element by a mask applied to one surface of said planar element.

4. The device of claim 3 wherein said reflector comprises a parabolic reflector.

* * * * *